US007080576B2

(12) United States Patent
Johnson et al.

(10) Patent No.: US 7,080,576 B2
(45) Date of Patent: Jul. 25, 2006

(54) MULTI-ACCESSORY HAMMER WITH RAPID RELEASE CHANGE MECHANISM

(75) Inventors: Ronald Leon Johnson, San Jose, CA (US); Idriss Mansouri-Chafik Ruiz, Santa Clara, CA (US); Skye David Barcus, Ben Lomond, CA (US); Steven Simas Escobar, Santa Clara, CA (US)

(73) Assignee: Wagic, Inc., Los Gatos, CA (US)

( * ) Notice: Subject to any disclaimer, the term of this patent is extended or adjusted under 35 U.S.C. 154(b) by 0 days.

(21) Appl. No.: 11/126,046

(22) Filed: May 9, 2005

(65) Prior Publication Data

US 2006/0032337 A1 Feb. 16, 2006

Related U.S. Application Data

(60) Provisional application No. 60/568,947, filed on May 7, 2004.

(51) Int. Cl.
*B25D 1/00* (2006.01)
*B25D 1/04* (2006.01)

(52) U.S. Cl. ..... 81/20; 81/489; 81/490; 7/143; 7/146; 7/147

(58) Field of Classification Search ..... 81/20, 81/489, 490; 7/143, 146, 147
See application file for complete search history.

(56) References Cited

U.S. PATENT DOCUMENTS 4,831,901 A * 5/1989 Kinne ..... 81/25
6,655,236 B1 * 12/2003 Slack et al. ..... 81/25

* cited by examiner

*Primary Examiner*—Lee D. Wilson
*Assistant Examiner*—Shantese McDonald
(74) *Attorney, Agent, or Firm*—Manatt, Phelps & Phillips

(57) ABSTRACT

A multi-accessory hammer is provided having an rapid release accessory change mechanism that includes a housing mounted to the butt end of a hammer and having an opening therein. A resilient means such as a spring is mounted within the housing, and an accessory locking device is mounted over the spring. One end of this locking device extends through the opening in the housing and is capable of rapidly hooking onto an accessory. The locking device also has a side arm extending along the exterior of housing and is capable of urging the locking device against the resilient means to allow unhooking of the accessory from the locking device.

5 Claims, 4 Drawing Sheets

MULTI-ACCESSORY HAMMER WITH RAPID RELEASE CHANGE MECHANISM

FIELD OF THE INVENTION

The present invention relates to a multi-accessory hammer having a rapid release accessory change mechanism.

BACKGROUND OF THE INVENTION

There are numerous examples of prior art directed to multi-accessory hammers and other striking tools in which interchangeable heads permit the user to insert various accessory tools into the head; see, for example, U.S. Pat. Nos. 723,764; 974,021; 1,33,124; 1,287,386; 1,869,850; 2,462,959; 2,763,172; 2,833,323; 2,938,412; 4,924,576; 5,255,575; and 6,347,562. Of these tools, one, U.S. Pat. No. 1,297,386, also modifies the handle to accommodate an accessory. Because the accessory is threaded into the butt end of the handle, the combination tool described in the '386 patent would not be considered to have a rapid release accessory change mechanism.

Additional examples of prior art that are directed to multi-accessory hammers and other striking tools that modify the handle to permit the user to provide additional uses for the tool include U.S. Pat. Nos. 298,650; 1,302,647; 1,221,655; 1,304,647; 1,717,562; 1,757,538; 4,741,059; 4,597,123; 5,490,437; 5,507,051; 5,546,832 5,636,398; and 6,196,088. However, no prior art reference discloses or suggests modifying the handle to accommodate a wide variety of accessories or a mechanism that permits the rapid release of an accessory from the handle for replacement with another accessory.

There is a need a hammer or similar tool having a striking face and a handle that can accommodate a variety of accessories. There is also a need for such a tool that permits one to rapidly attach a wide variety of accessories and to rapidly release and exchange one accessory for another.

BRIEF DESCRIPTION OF THE DRAWINGS

The advantages of the present invention will become more readily appreciated by reference to the following detailed description, when taken in conjunction with the accompanying drawings, wherein.

DETAILED DESCRIPTION OF THE INVENTION

Figure 1:
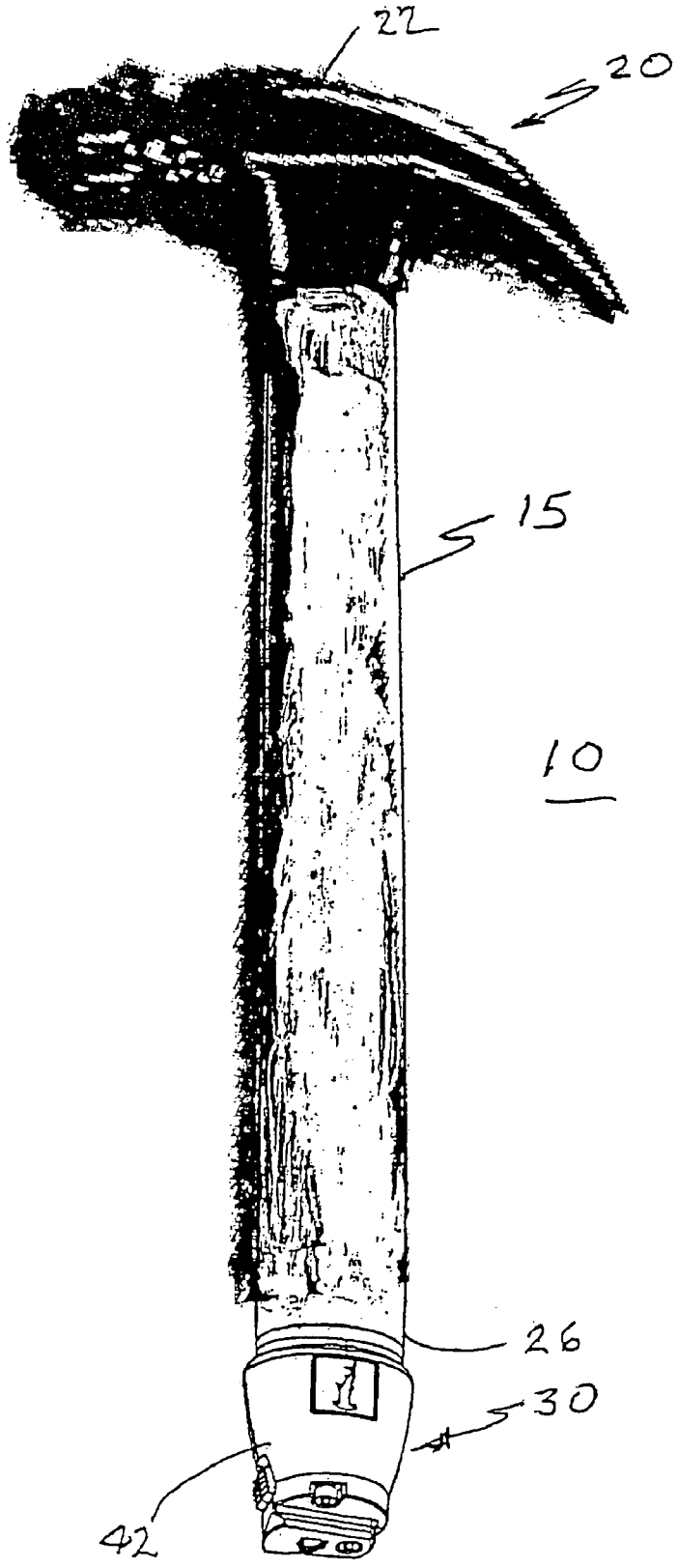
FIG. 1 is a perspective view of a one embodiment of the hammer of the present invention.
Figures 2A, 2B:
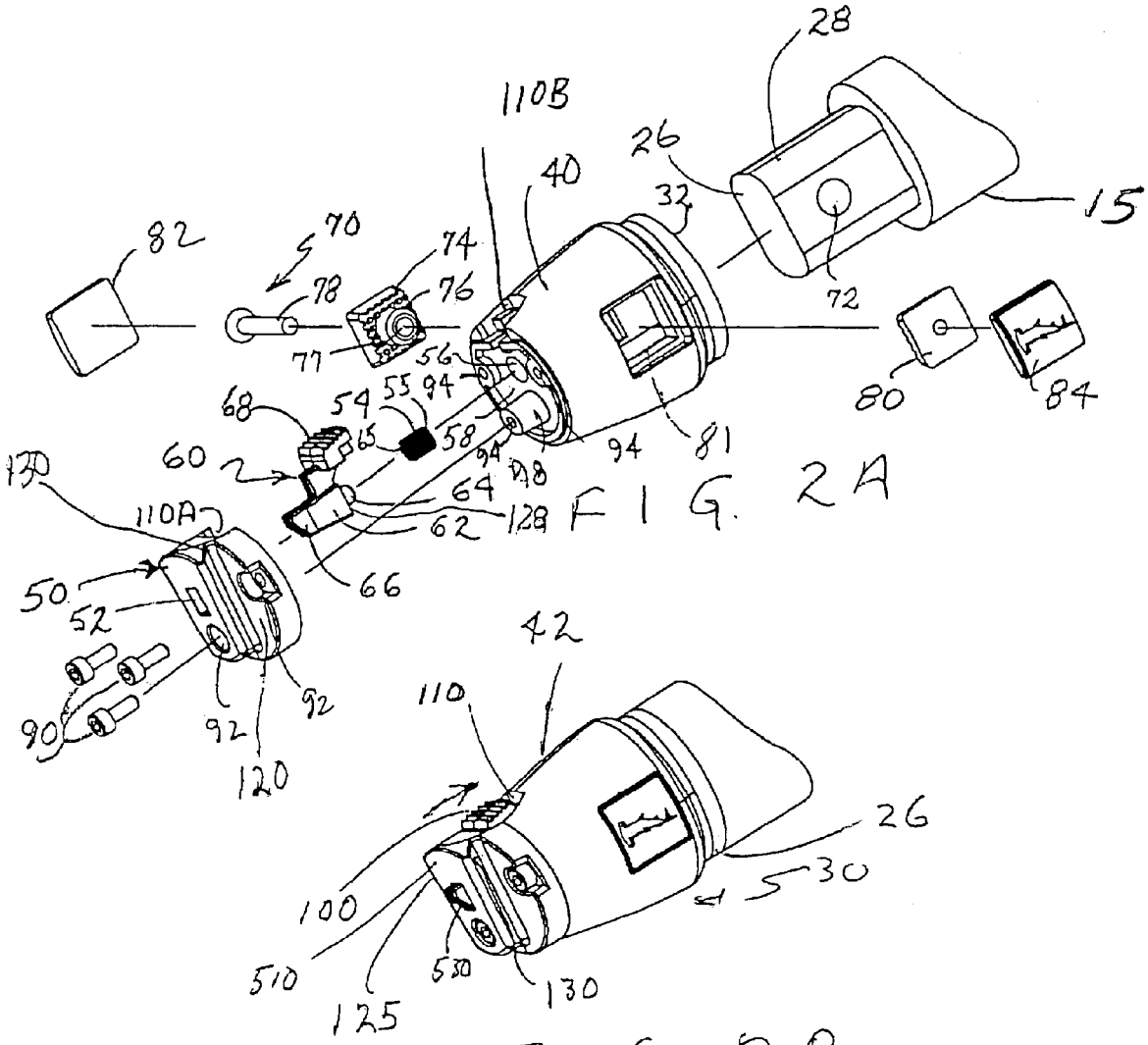
FIG. 2A is an exploded perspective vertical view of the rapid release accessory change mechanism of the embodiment of the present invention shown in FIG. 1.
FIG. 2B is a perspective vertical view of the accessory change mechanism of the preferred embodiment of the present invention shown in FIG. 1; of the present invention

Referring now to FIGS. 1, 2A, and 2B, various views are presented of illustrating one embodiment of multi-accessory hammer of the present invention is hammer 10 having a conventional wooden handle 15. One end of hammer 10 is attached to head 20 through eye 22. Butt end 26 is attached to rapid release accessory change mechanism 30. A portion of handle 15 adjacent butt end 26 is indented to form tenon 28 that is shown in FIG. 2A in a position for insertion into orifice 32 of base 40 of rapid release accessory change mechanism 30.

Housing 42, as shown in FIG. 1, preferably made of stainless steel, includes base 40 and cap 50 having opening 52 therethrough. Resilient means, preferably a coil spring 54, has end 55 for positioning within recess 56 in inner surface 58 of base 40 of housing 42. Accessory locking device 60 within housing 42 includes: (a) spindle 62 that has protrusion 64 that fits within end 65 of spring 54, (b) hook end 66 at the opposite end from protrusion 64, and (c) side arm 68.

After tenon 28 is inserted within orifice 26 of base 40, fastener means 70 unites tenon 28 of handle 15 through channel 72. Specifically, spacer 74 has protrusion 76, which in turn has opening 77. Protrusion 76 is designed to fit the dimensions of channel 72 without clearance. Bolt 78 passes through opening 77 of protrusion 76 and is threaded onto nut 80 that is lodged within indent 81 on one side of base 40. Plates 82 and 84 are respectively force fitted into an indent (not shown) on the other side of base 40 and orifice 81. An epoxy is used to insure that the indents remain securely fastened to handle 15. The use of nuts and bolts can be replaced by a variety of other fasteners well known in the art including rivets.

After base 40 is securely fastened to handle 15, cap 50, which has its outer dimensions substantially the same as the outer dimensions of base 50, is fastened to base 40 by means of bolts 90 through holes 92 and into threaded holes 94 in base 40. Internal spacer 98 serves to maintain the necessary internal spacing within housing 42 to accommodate accessory locking device 60. After cap 50 is securely fastened to base 40, side arm 68, preferably having finger grooves 100, is passed though opening 110 formed by gaps 110A and 110B in cap 50 and base 40, respectively. In addition, hook end 66 is passed through opening 52 in cap 50 and is in the accessory receiving position. Hook end 66 is designed to mate and prevent lateral motion of the accessory that is attached to accessory change mechanism 30. After assembly, spring 54 is positioned between shoulder 128 on spindle 62 and the inner bottom of recess 56 and functions in the manner discussed in greater detail below.

End 120 of cap 50, opposite the portion of cap 50 that is attached to base 40, has wedge 125 extending outwardly therefrom and has opening 52 therethrough. Cap 50 with wedge 125 is preferably is cast as a single unit of stainless steel. Wedge 125 is formed by two inwardly slanting and diverging walls 130 as shown in FIGS. 2A and 2B. The scale shown in these figures is approximately the dimensions of existing prototypes of this embodiment of the present invention. The degree of overhang of the inwardly slanting walls is important to assure that no reasonable force during use of the accessory allows for accessory change mechanism 30 to unintentionally release from handle 15.

Figure 3A:
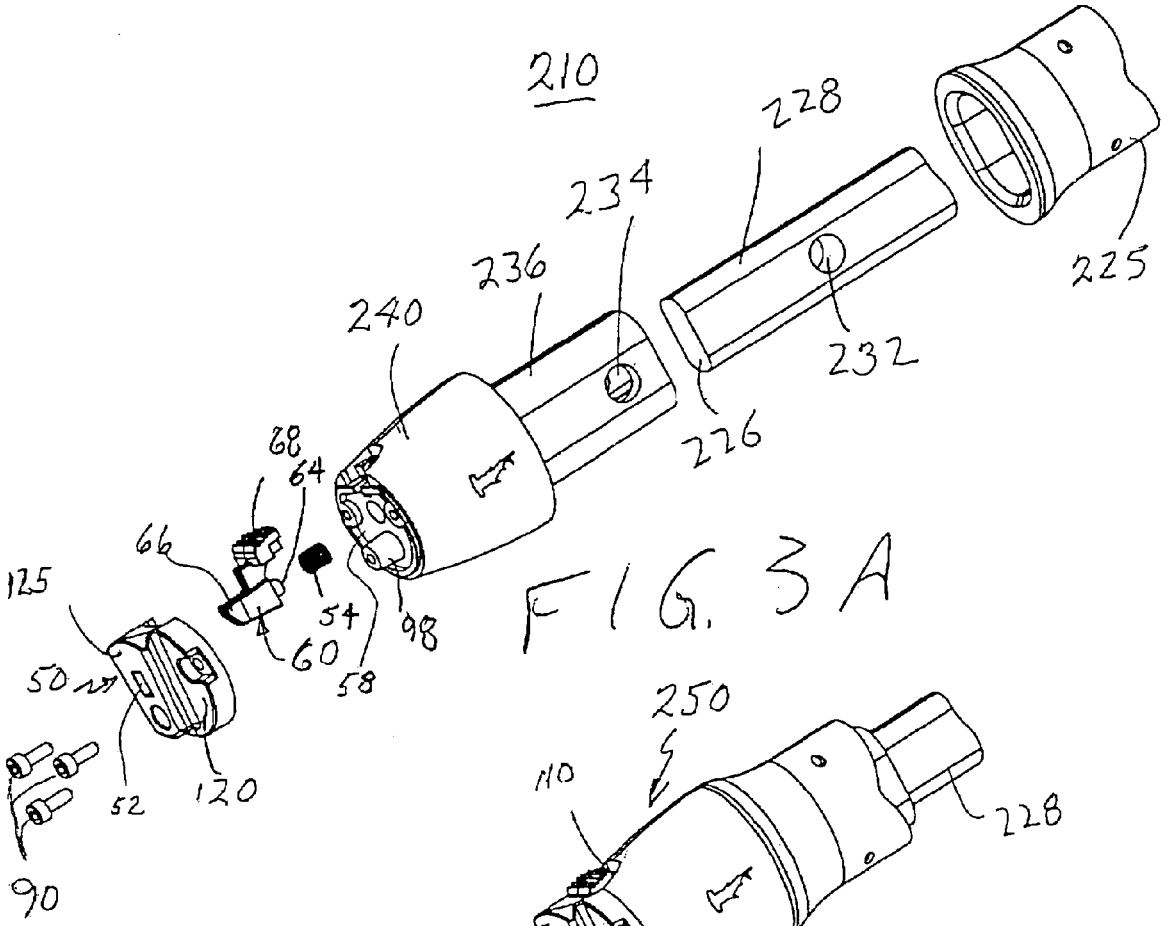
FIG. 3A is an exploded perspective vertical view of the accessory change mechanism of another embodiment of the present invention.
Figure 3B:
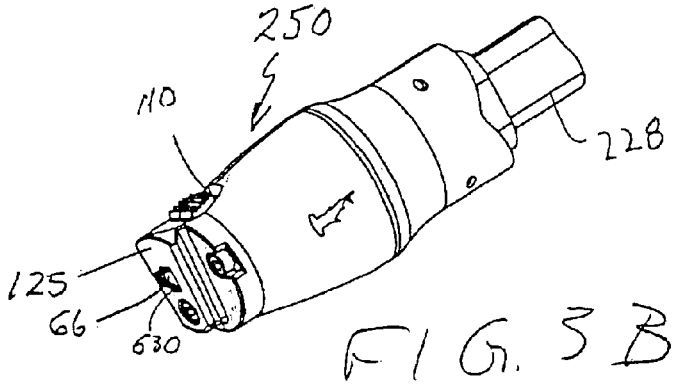
FIG. 3B is a perspective vertical view of the accessory change mechanism of the embodiment of the present invention shown in FIG. 3A; of the present invention
Figures 4A, 4B, 4C, 4D, 4E:
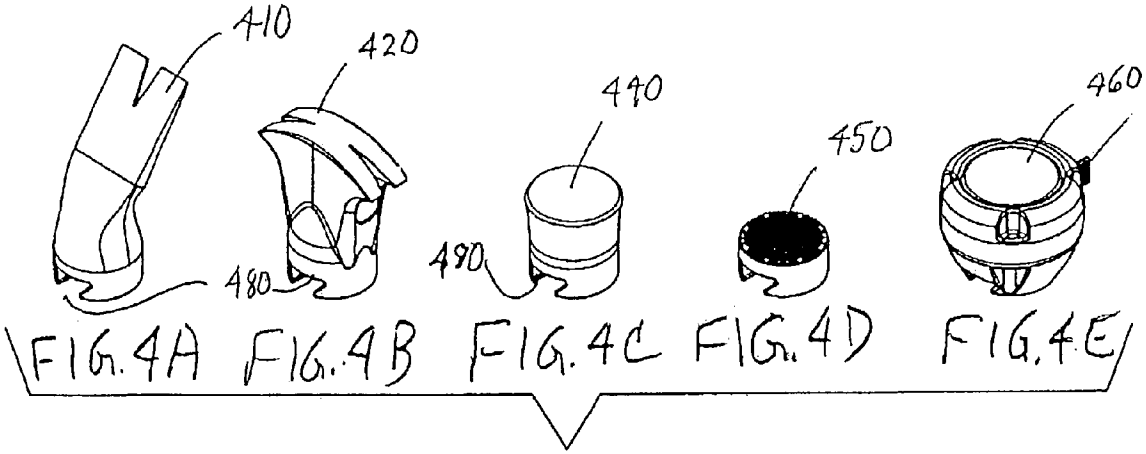
FIG. 4A is a perspective view of a crowbar accessory to the hammer of the present invention.
FIG. 4B is a perspective view of a fastener removal accessory to the hammer of the present invention.
FIG. 4C is a perspective view of a elastic striking element accessory to the hammer of the present invention.
FIG. 4D is a perspective view of a metal striking accessory to the hammer of the present invention.
FIG. 4E is a perspective view of a retractable tape measure accessory to the hammer of the present invention.

Referring now to FIGS. 3A and 3B, another embodiment of multi-accessory hammer of the present invention is hammer 210 having a partially hollow glass fiber handle 225. Insert 228 having hole 232 to match hole 234 in protrusion 236 of base 240 of accessory change mechanism 250. The same fasteners are used to attach mechanism 250 to handle 225 that are described above in connection with hammer 10. All of the remaining elements of mechanism 250 are the same as those of mechanism 30 described above.

FIGS. 4A–4E show several types of accessories for attachment to any of the embodiments of the multi-accessory hammer of the present invention, such as crowbar accessory 410, fastener removal accessory 420, elastic striking element accessory 440, e.g., hard rubber striking element, metal striking element accessory 450, e.g., stainless steel striking element, and retractable tape measure accessory 460. The foregoing types of accessories are those for which prototypes have been made. However, it is apparent to one skilled in the art that many other accessories can be designed to fit the butt end of a hammer or other striking tool of the various embodiments of the present invention.

Figure 5A:
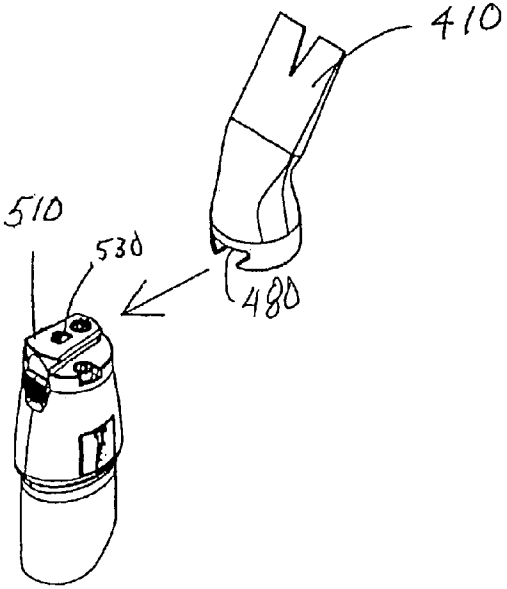
FIG. 5A is a perspective view of the accessory prior to attachment to the accessory change mechanism.
Figures 4F, 5B:
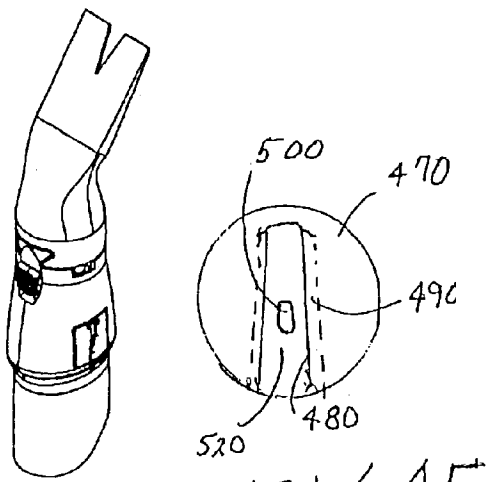
FIG. 4F is a bottom view of each of the accessories to the hammer of the present invention.
FIG. 5B is a perspective view of the accessory after to attachment to the accessory change mechanism.

FIG. 4F shows mating end 470 common to each of the types of accessories and preferable is made of stainless steel. Mating end 470 contains notch 480 that is capable of mating with inwardly slanting and diverging walls 130 of wedge 125 on the outside portion of the cap, end 120. The purpose of mating inwardly slanting and divergent walls on each of wedge 125 and notch 480 is to prevent movement of the accessory in a first direction that is transverse to the direction the accessory moves along outer surface 510 of wedge 125. Mating end 470 also contains recess 500 that is capable of mating with hook end 66 of spindle 62. The purpose of accessory locking device 60 is to prevent movement of the accessory along surface outer surface 510 of wedge 125 and to permit rapid attachment of accessory to locking device 60 as described below.

A typical configuration of the hammer of one of the embodiments of the present invention is to include tape measure accessory 460, one of the most practical accessories to have at the butt end of a hammer. If a user wishes to change to crow bar accessory 410, as shown in FIGS. 5A and 5B, the user would holds one hand on handle 15 or handle 225 of hammer 10 or 210 adjacent side arm 68 and urge side arm 68 toward butt end 26 along the direction the arrow shown in FIG. 2B is pointed. This causes spindle 62 to compress spring 54, which in turn causes hook end 66 to move so that it is flush with the surface 510 of wedge 125. The user then slides accessory 460 along surface 510 until the walls of notch 480 are completely free of the walls of wedge 125. Once accessory 460 has been removed, the user releases side arm 68. This causes spring 54 to return to its original position and causes hook end 66 to spring through opening 52.

Because of the matching diverging walls, slide crow bar accessory 410, assuming that is the next accessory to be attached, can only slide along the outer surfaces of wedge 124 in one direction. In this direction, bottom surface 520 of the accessory pushes against angled side 530 of hook end 66 causing spring 54 to compress until end 66 is directly over recess 500. At this point, end 66 is urged into recess 500 as the result of the uncoiling of spring 54. Once hook is locked into place in recess 500, no further movement of accessory is possible until the user urges slide arm 66 toward the butt end as described above. This entire change can be done in less than a second of time assuming the user has the accessories readily available, such as in a shop apron or a pant pocket. The relatively small size of all accessories for the hammer of this invention allows a large number of accessories to be readily available for change at any given time.

Various modifications of the multi-accessory hammer of the present invention in addition to those shown and described above will become apparent to those skilled in the art from the foregoing description and accompanying drawings. Such modifications are intended to fall within the scope of the appended claims.

What is claimed is:

1. A multi-accessory hammer comprising:

a head;

a handle having one end attached to said head and a butt end;

an accessory change means attached to the butt for rapidly attaching and releasing an accessory; and more than one accessory capable of being attached to said accessory change means;

wherein said accessory change means comprises a housing mounted to said butt end and having an opening therein, a resilient means mounted within the housing, and an accessory locking device mounted over the resilient means having one end extending through the opening in the housing capable of rapidly hooking onto an accessory and a side arm extending along the exterior of the housing capable of urging the locking device against the resilient means to allow releasing of the accessory from the locking device.

2. The hammer of claim 1, wherein said resilient means is a spring.

3. A multi-accessory hammer comprising:

a head having an eye;

a handle having a neck extendable through the eye and a butt end;

an accessory change mechanism including:

a housing comprising a base fixedly attached to said butt end and a cap fixedly attached to said base and having an opening therethrough, a spring mounted within the base of the housing, and an accessory locking device within the housing having:

a spindle with one end mounted over the spring and a hook end extending through the opening in the cap capable of hooking to an accessory, and a side arm extending from said spindle to the exterior of housing so that when the side arm is pushed along the side of the housing the spindle compresses the spring to move the hook end away from any accessory attached to the locking device and rapidly releasing the accessory; and a plurality of accessories capable of being attached to said accessory change mechanism.

4. The hammer of claim 3, wherein the cap has an first portion that has substantially the same outer dimensions as that of the base to which it is attached and an end that has a wedge thereon formed by two inwardly slanting and diverging walls and the opening in the cap extends through the wedge.

5. The hammer of claim 4, wherein each of said accessories has a mating end with a notch that is capable of mating with the inwardly slanting and diverging walls of the wedge on the outside portion of the cap to prevent movement of the accessory in a first direction and a recess that is capable of mating with the hook end of said spindle to prevent movement of the accessory in a direction transverse to the first direction.

* * * * *